US005339293A

United States Patent [19]

Kamiyama et al.

[11] Patent Number: 5,339,293

[45] Date of Patent: Aug. 16, 1994

[54] WATCH WITH HANDS FOR MULTIPLE TIME DISPLAYS

[75] Inventors: Yasuo Kamiyama; Takeo Mutou; Takashi Osa, all of Tanashi, Japan

[73] Assignee: Citizen Watch Co., Ltd., Tokyo, Japan

[21] Appl. No.: 50,106

[22] PCT Filed: Sep. 11, 1992

[86] PCT No.: PCT/JP92/01167

§ 371 Date: May 10, 1993

§ 102(e) Date: May 10, 1993

[87] PCT Pub. No.: WO93/06535

PCT Pub. Date: Apr. 1, 1993

[30] Foreign Application Priority Data

Sep. 13, 1991 [JP] Japan ..... 3-81871[U]
Mar. 13, 1992 [JP] Japan ..... 4-21958[U]

[51] Int. Cl.[5] ..... G04B 19/22; G04B 19/24; G04B 19/04

[52] U.S. Cl. ..... 368/21; 368/28; 368/80; 368/110; 368/190

[58] Field of Search ..... 368/21-27, 368/28, 31-34, 185, 190

[56] References Cited

U.S. PATENT DOCUMENTS 1,046,246 12/1912 Albrecht ..... 368/21
2,635,414 4/1953 Cottier ..... 368/21
4,674,889 6/1987 Klaus ..... 368/28
5,086,416 2/1992 Dubois et al. ..... 368/18
5,177,712 1/1993 Kakizawa ..... 368/28
5,235,562 8/1993 Vaucher ..... 368/28

FOREIGN PATENT DOCUMENTS 55-30676 3/1980 Japan .
57-122375 7/1982 Japan .
59-31470 2/1984 Japan .
60-70390 4/1985 Japan .
62-251690 11/1987 Japan .
63-128284 5/1988 Japan .

*Primary Examiner*—Vit W. Miska
*Attorney, Agent, or Firm*—Kanesaka & Takeuchi

[57] ABSTRACT

A dual center wheel (38), provided with a plurality of dual center wheels (36) for display of times in different time zones, driven on a hands wheel for displaying the current time, and a dual adjustment member (49) adjusted by an external adjustment member (9), is formed from a gear (38*a*) and a pair of planetary wheels (44, 45) supported on the gear (38*a*). The dual center wheel (38) is also provided with a dual wheel (43), for which the rotation is regulated by means of a jumper spring, which engages one of the planetary wheels (44), and with a dual hour wheel (46) which engages the other planetary wheel (45) rotating on the same shaft as the dual wheel (43). The dual hour wheel ( 46 ), of which rotanional speed is reduced as a result of the rotation of the dual center wheel (38), makes one turn of an integer fraction of a rotation for a one pitch rotation of the dual wheel ( 43 ).

5 Claims, 13 Drawing Sheets

WATCH WITH HANDS FOR MULTIPLE TIME DISPLAYS

FIELD OF TECHNOLOGY

The present invention relates to a watch with an improved gear train structure which actuates hands for multiple time displays, and, in particular, to a watch with hands for multiple time displays for which a low price is possible because of reduced cost of the movement, which has superior design characteristics, and for which the hands in the sections displaying times in other time zones are set simultaneously with the setting of the hands for the current time.

BACKGROUND ART

Conventionally, there are multiple time zone display watches, such as a world-clock display found as a kind of digital watches, which can display different times in addition to the current time. As is commonly known, such a digital watch displays time other than the current time by switching the display by the operation of a push button or the like.

Recently, watches which can indicate multiple times using hands for display have also been developed. Specifically, these watches are provided with several display sections, in which the times for other time zones are directly displayed as local times, in addition to the current time display for the locality in which the watch is being used, or, these are watches which display times for other time zones, to which a different-time display function has been added, with the display being switched by the operation of a push button or the like.

The structure of the movement for a hands-display type of watch, on which a plurality of times is displayed in a multi-display section as outlined above, utilizes a plurality of small, finished movements, normally used on bracelet-type watches for women, or the like, which are secured to the watch case and housed at specified locations on a convex section provided on an inner frame of synthetic resin, with a face plate and hands mounted on the individual movements. Thus, multiple hands are used to indicate a plurality of time zones. A watch with this type of structure for displaying many time zones has, therefore, the same number of time display sections as the number of watch movements. The wearer can readily use both a current time display and other-zone time displays by optionally selecting the plurality of time display sections.

The times on this type of watch are adjusted using crowns on an extended line connected to the center section of the timepiece and the center of each of the various time display sections, as external operating means. The wearer can therefore set the various times by pulling out and operating the crown matching the respective time display section.

Further, among multi-time-zone watches with a plurality of crowns, a specially designed watch, which places the crowns close to the band clasp in the case of a watch in which the crowns overlap on the wrist band, either top side or under side, has been developed.

However, these multi-time-zone watches with hands-display-type have a difficulty in aligning a plurality of small movements mounted on the concave housing section of the inner frame, so that it tends to invite the occurrence of a temporary-stoppage phenomenon by interference or deviation of the clearance hole of a hour wheel for attaching an hour hand on the watch-face, or tends to give an awkward appearance.

In addition, because the multi-time display consists of a plurality of small movements, a large number of steps in the assembly process is required, and because the large number of parts the cost of the watch movement becomes rather high. It consequently leads to a high price wrist watch. Also, the watch becomes rather large in shape in comparison with other watches.

Further, the hands in the multi-time display sections must be independently adjusted. For example, when the above-mentioned time display sections are positioned right above or right below a part of the watch, the crowns are difficult to operate, making it extremely difficult for the wearer to set the hands. Also, because the various display sections are driven independently, reading errors may be caused from errors in operation the crown by the wearer.

Another structure used in a movement for a hands-equipped watch for indicating multiple times is the type as described in FIG. 1 and FIG. 4 of Japanese Utility Model Laid-open Publication No. 120684/1989. In the watch described in this patent publication, the gear train extends in four directions from an hour wheel so that many different times are displayed by a plurality of hands on a plurality of display wheels positioned in concentric circles.

However, in a hands-equipped watch for indicating multiple times shown in FIG. 1 of Japanese Utility Model Laid-open No. 120684/1989, the gear train must extend in many directions from the hour wheel and much work is required in the manufacturing of the gear train and the assembly of the watch movement and the like because a pair of intermediate wheels (referred to as planetary wheels in the publication) must be placed on one display wheel. This results in an increase in costs.

In another embodiment shown in FIG. 4, for example, when a hands-equipped multi-time display watch is planned to manufacture, there is a danger of misreading the minute units for the hour characters. Practically, the moving direction of the hands for displaying the times in other zones is the reverse of the direction of rotation of the hands for the current time.

Also, a planetary wheel method Lot a normal hands-equipped watch with three hands and the like to which a time difference display function is added has been proposed for an embodiment in Japanese Patent Laid-open Publication No. 30676/1980. The embodiment of this method comprises a position-regulated dual wheel with 11 teeth, a planetary wheel, and an hour wheel with 12 teeth to which an hour hand is attached. In this method, the planetary wheel moves along the periphery of the dual wheel in line with the rotation of a second wheel which rotates once in 60 minutes so that the hour wheel is rotated at a reduction ratio of 1/12.

However, in the watch with a time adjustment mechanism proposed in Japanese Patent Laid-open Publication No. 30676/1980, the hour hand in the normal display of the current time is moved for Lime adjustment when viewing the local time in another time zone on the watch. This creates the problem that it is difficult to determine the local time because the current time has been switched.

On the other hand, in a day-adjustment mechanism for a calendar gear train structure on a watch with hands for multiple time displays rotational force from a watch drive gear train is transmitted to a day rotary wheel which engages the hour wheel so that a day plate is fed by the engagement of a day feed hook, provided on the day transfer wheel, with the teeth on the day plate. In this day feed mechanism, in order to ensure that no more than two of the teeth on the day plate are advanced during the day feed, the shape of the day rotary wheel is deformed by the provision of an obstruction on the outer periphery of the day rotary wheel, so that only o:,.e tooth is engaged, advancing exactly one day's amount.

Also, a fast feed mechanism in a calendar gear train structure for a conventional hands-display watch works, when the crown is rotated at a one-step pull state, with a fast adjustment transmission lever via a transmission lever which engages the rotary action of a hook provided on a sliding pinion, so that the day plate is advanced by the day feed hook provided on the fast adjustment lever.

The day feed mechanism in the former calendar gear train structure for the hands-display watch is provided with an outer wall or an obstruction on the outer periphery of the day rotary wheel. By deforming the shape of the day rotary wheel, a feed hook which projects to engage the day plate controls the amount of engagement with the teeth of the day plate so that no more than two of the teeth of the day plate are fed in one day. This mechanism, however, entails a drawback that the day rotary wheel must have a complicated shape to be deformed.

Also, the fast adjustment mechanism in the latter calendar gear train structure for the hands-display watch must be linked with the sliding pinion, the fast adjustment lever, and the day plate. Therefore, not only is a large number of parts required, but there is also the drawback that it is difficult to obtain reliable operation with the large number of parts. In addition, although this mechanism is appropriate for the case of teeth with a large pitch such as a ring-shaped day plate positioned on the outer periphery of the watch module, it has a drawback that it is difficult to adjust small gears because the range of action of the feed hook for the fast adjustment lever is widened.

Accordingly, an object of the present invention is to provide a watch with multiple time displays without the problems associated with a conventional watch with hands for multiple time displays.

Specifically, an object of the present invention is to provide a low-priced watch with hands for multiple time displays in which an increase in the diameter of the watch is avoided, and which allows a superior design and good operability so that the wearer finds it easy to use.

A further object of the present invention is to provide a watch with hands for multiple time displays equipped with a highly reliable calendar gear train structure in the case where hands are used for indication the calendar.

DISCLOSURE OF THE INVENTION

These objects are achieved in the present invention the provision of a watch with hands for multiple time displays comprising a hands drive wheel for a minute wheel and the like for driving hands at approximately the center of a display section, and a transmission wheel a second minute wheel or the like which engages the hands drive wheel, wherein the transmission wheel engages an auxiliary hands drive wheel for a plurality of dual center wheels and the like for displaying at least two or more different times.

Owing to this structure, a reduction in the number of parts for the movement and a reduction of the number of steps in the assembly process are achieved, and a low cost can be realized because of a reduction in the cost of the movement. In addition, it is possible to simplify an inner frame for securing the movement in the watch case. As a result it is possible to obtain a highly reliable watch with hands for multiple time displays, which makes it possible to avoid an increase in the diameter of the watch and to prevent problems, which are often experienced on conventional watches, such as interference and friction or the like between an hour wheel and the clearance hole provided on the dial.

Also, as opposed to the case o[a conventional watch with hands for multiple time displays incorporating a plurality of movements, it is possible to obtain a watch with good design characteristics because the position an external operating member with respect to the position of a section for displaying a different time is not restricted. Also, the hands for displaying the current time are Longer than those for the sections in which the other times are displayed. Therefore, the time can be easily viewed in the same manner as for a normal three-hand-display watch.

Furthermore, the present invention is a watch with hands for multiple time displays, comprising a hands wheel for the current time display; a plurality of dual wheels for displaying times in other time zones, driven by the hands wheel; an external adjustment member; and a dual adjustment member adjusted by the external adjustment member. Said dual wheel is composed of a gear and two planetary wheels rotatably supported by that gear. In addition, the watch with hands for multiple time displays also comprises a dual wheel rotatably regulated by means of a jumper spring which engages one planetary wheel, and a dual hour wheel which engages the other planetary wheel coaxially with the dual wheel. The dual hour wheel rotates at a reduced speed in line with the rotation of the dual wheel, making an integer fraction of one rotation for one pitch rotation of the dual wheel.

As a result, it is possible to set the hands for displaying a different time zone simultaneously by merely setting the hands for displaying the current time. Further, the time displayed in a different time zone can be adjusted by a one-touch push button operation. The operation is easy to understand for the wearer so that it serves to eliminate operation errors. It is also possible to prevent the conventional type of display setting errors. In addition, no deviation is produced between the minute hand for the current time and the minute hands for the other times due to the gear train backlash between the current time display gear train and the different time display gear train, which is experienced when adjusting the time difference by rotating the crown, defending on the direction of rotation. Also, the hour hands for the other time zones are not affected by the backlash of the planetary gear train in reverse direction, but are normally affected in advance direction so that the wearer is able to use the watch with assurance.

Furthermore, in the case of a watch which can display a calendar, the present invention provides a mechanism that can regulates the moving locus of a feed hook of a fast adjustment lever for adjusting a day hand drive gear by giving an initial reflection to the calendar gear train with a regulating boss. Also, a fast adjustment hook for engaging a fast adjustment lever provided in a sliding pinion of the watch so that the fast adjustment lever is operated by rotation of a crown.

According to the present invention, the number of parts of the movement is further reduced so that the cost is reduced, and improvements in design and operability can be attained.

BEST MODE FOR CARRYING OUT THE INVENTION

Figure 1:
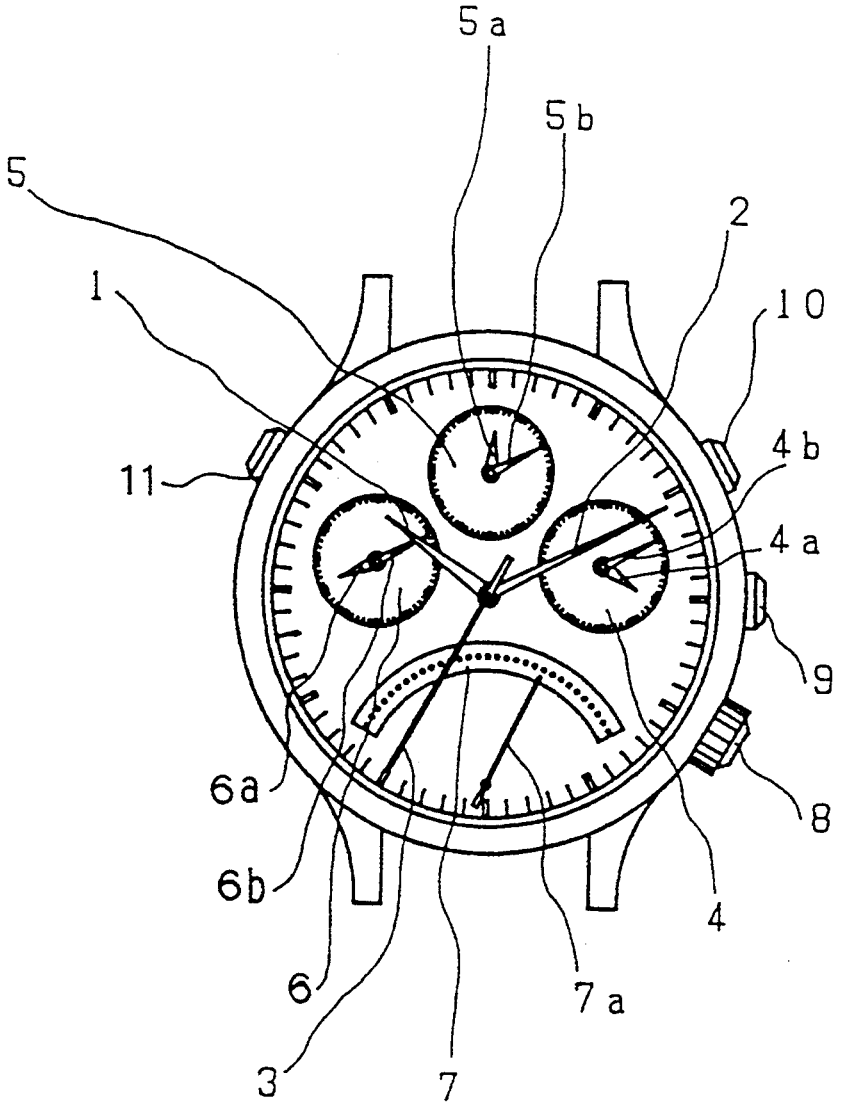
FIG. 1 is an external view of a preferred watch according to the present invention.

A watch with hands for multiple time displays shown in FIG. 1 comprises a watch 1 which rotates once every 12 hours with a center of rotation at approximately the center of the watch, a minute hand 2 which rotates once every 60 minutes on the same shaft as the watch 1, and a second hand 3 which rotates once every 60 seconds on the same shaft as the watch 1. These hands show the current time at the actual location.

A first different-time display section 4 for displaying a first different time, a second different-time display section 5 for displaying a second different time, and a third different-time display section 6 for displaying a third different time, are positioned in three different directions respectively, each at an approximately equal distance from the approximate center of the watch. The different-time display sections 4, 5, and 6 display the different times using two hands. These are different-time hour hands (hereinafter referred to as LT hour hands) 4*a*, 5*a*, and 6*a*, which make one rotation in every 12 hours, and different-time minute hands (hereinafter referred to as LT minute hands) 4*b*, 5*b*, and 6*b*, which make one rotation every 60 minutes. A calendar display section 7 displays the date by means of a swinging drive operation of a day hand 7*a* which makes a complete swing during a one-month period.

A crown 8, acting as an external operating member, can be drawn out in two stages to provide external switching. The crown 8 is normally used in the fully depressed position (0-stage position). In the one-stage pull state, a fast adjustment of the date is possible when the crown 8 is rotated to the right. In the two-stage pull state, the second hand 3 can be stopped at an optional position, and when the crown 8 is rotated to the left and right, the hour hand 1 and the minute hand 2 are rotated so that the hands can be set at the current time. A plurality of push buttons 9, 10, 11 ( hereinafter referred to as PB 9, 10, 11) are external operating members for adjusting the LT hour hands 4*a*, 5*a*, 6*a*. Each time the PB9 is depressed, the LT hour hand 4*a* of the first different-time display section 4 can be adjusted in one hour units. Similarly, pressing the PB10 adjusts the LT hour hand 5*a* of the second different-time display section 5, and pressing the PB11 adjusts the LT hour hand 6*a* of the third different-time display section 6 in the same manner. The adjustment of those hands is always possible by the operation of PB9, PB10, and PB11 irrespective to the draw-stage position of the crown 8.

The basic structure of the watch movement will now be explained.

In the watch movements illustrated in FIG. 2 and FIG. 3, a hatched section shown at approximately the center of the watch movement is a module with three small hands (hereinafter referred to as basic module A) which are produced by large scale mass production to provide a module at reduced cost.

Figure 6:
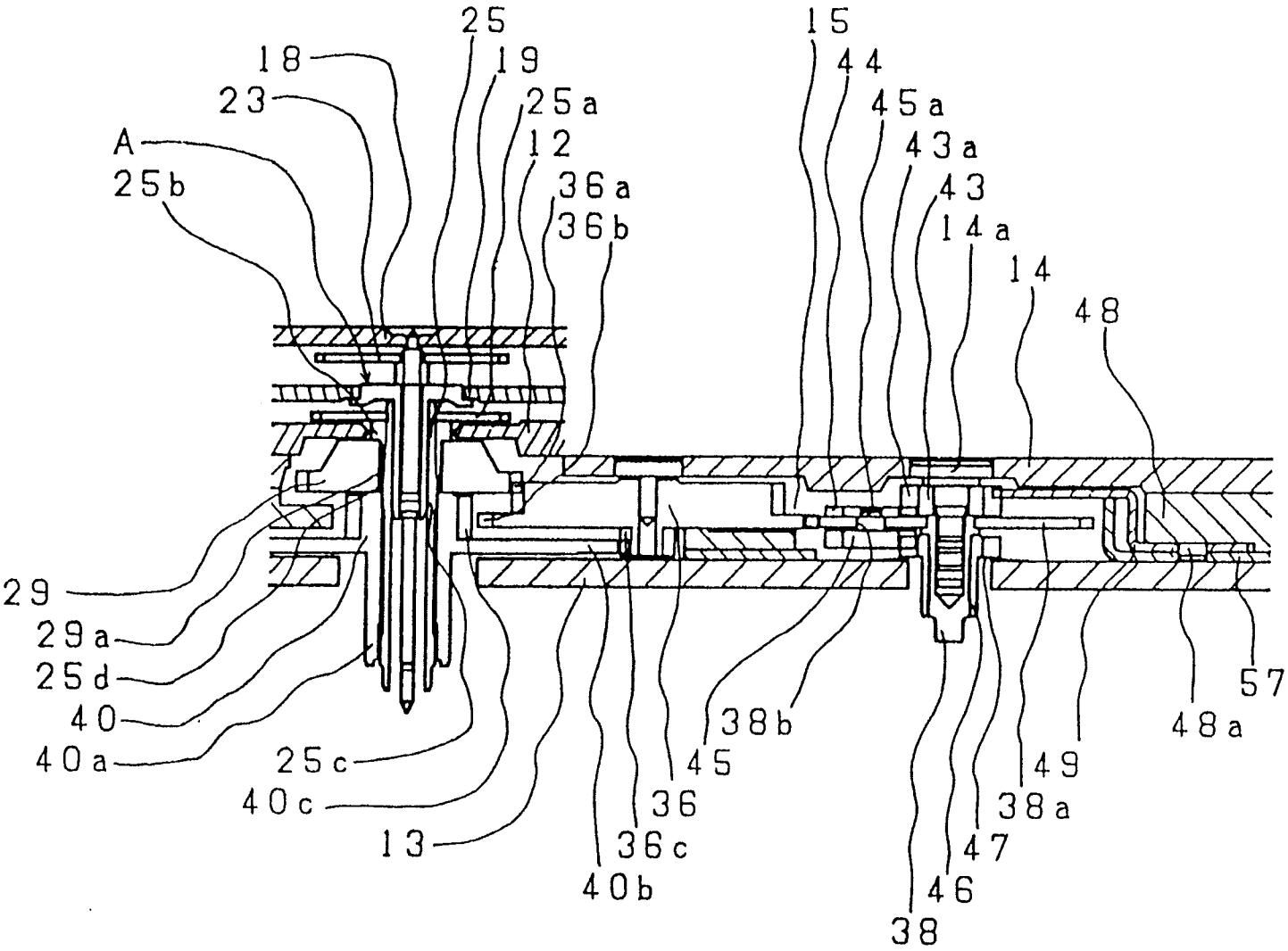
FIG. 6 is a sectional view of the principal parts of a gear train mechanism of the watch illustrated in FIG. 1.
Figure 7:
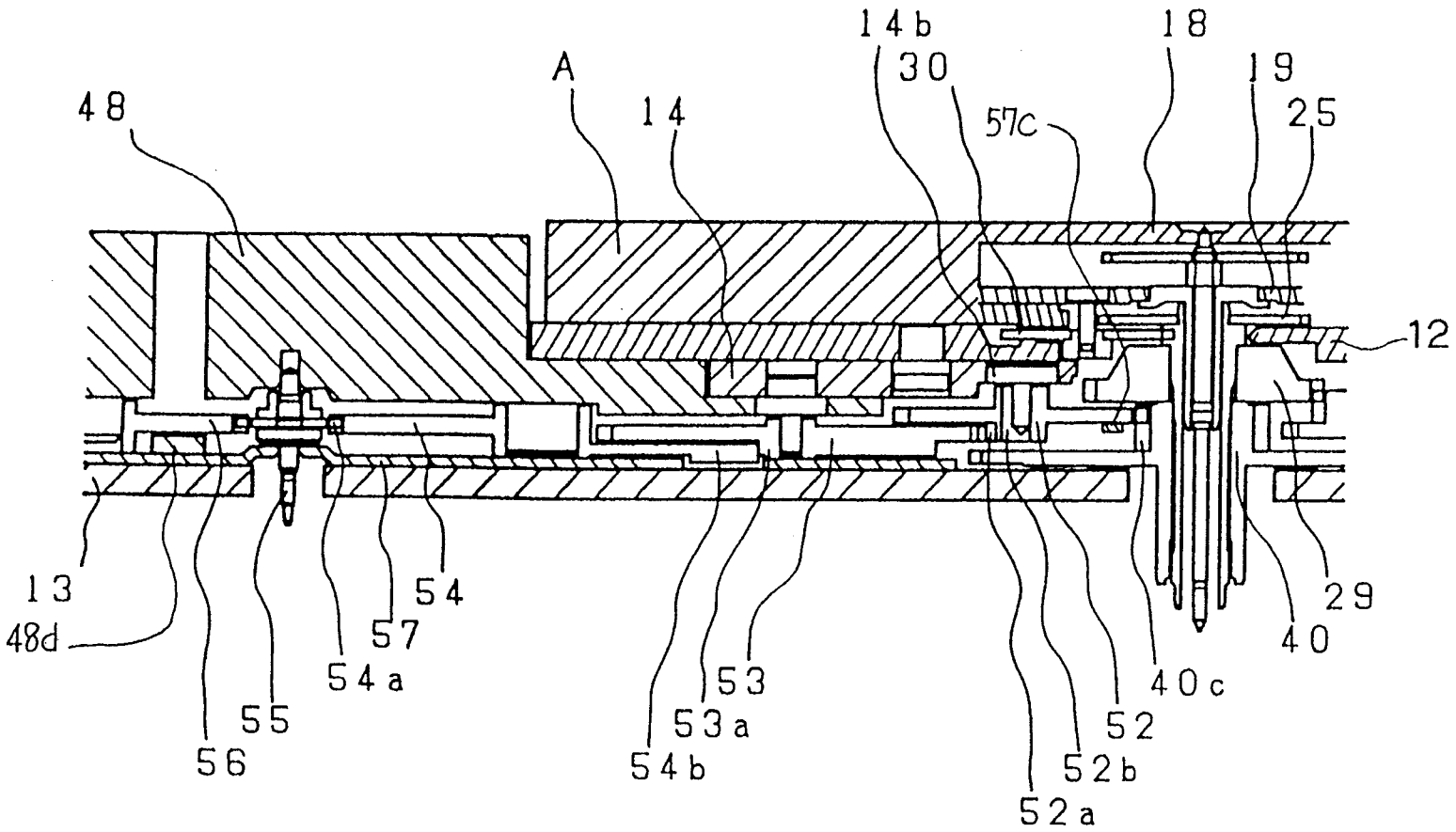
FIG. 7 is a sectional view of the principal parts of a gear train mechanism of the watch illustrated in FIG. 1.
Figure 8:
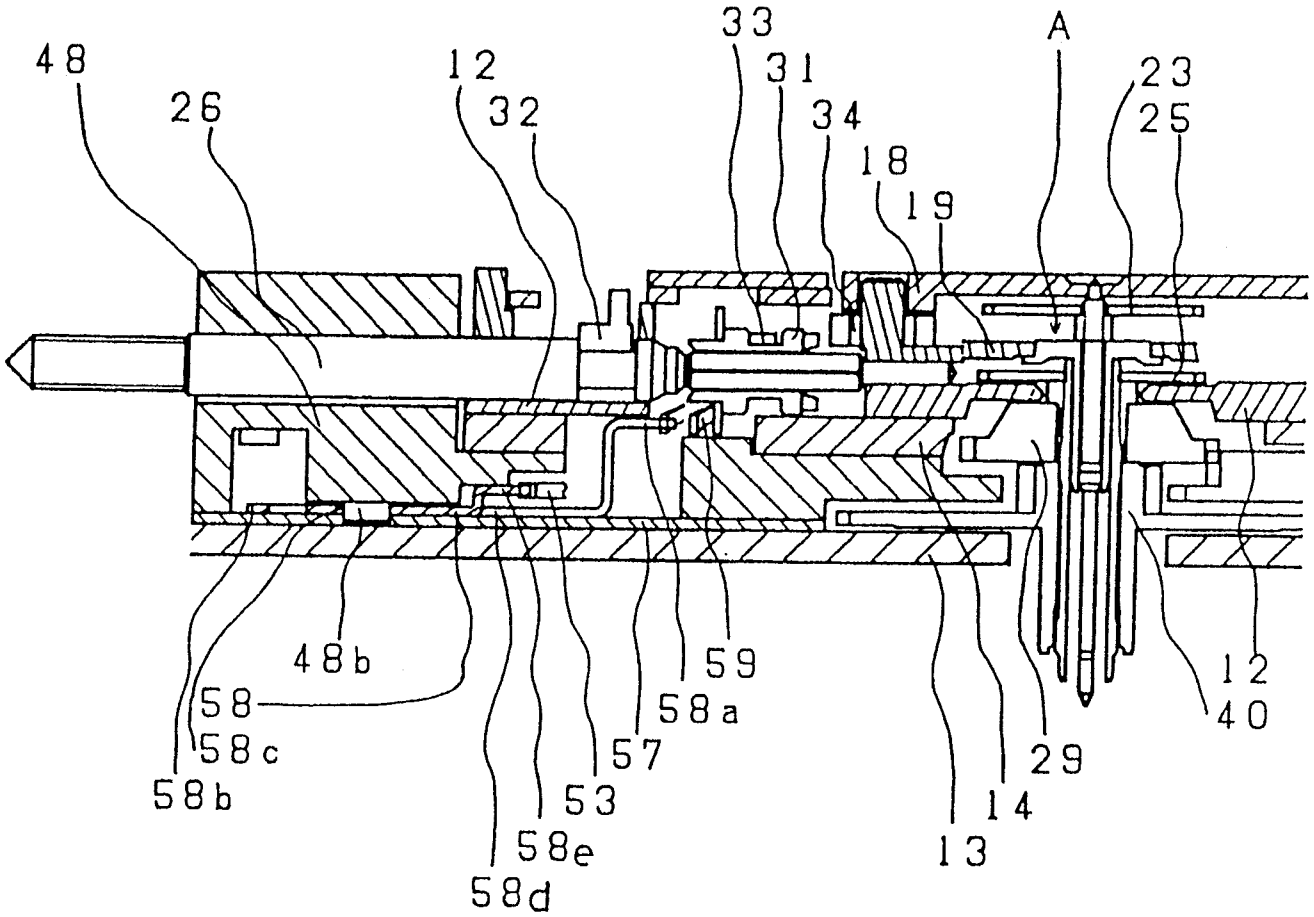
FIG. 8 is a sectional view of the principal parts of a gear train mechanism of the watch illustrated in FIG. 1.

Referring to FIGS. 6 to 8, the watch movement of the present invention has a two-layer structure. The basic module A is positioned on the back cover side, and is mounted on a foundation plate 12 which is a basic support for the base module A, while a different-time display gear train 15 supported by a lower bearing 14 and a calendar display gear train 16 and the like are arrange in a hollow cross-section between the foundation plate 12 and a dial 13. The foundation plate 12 and the lower bearing 14 are temporarily secured by a screwed section (not shown) provided in one location for stabilizing the parts during assembly.

Figure 2:
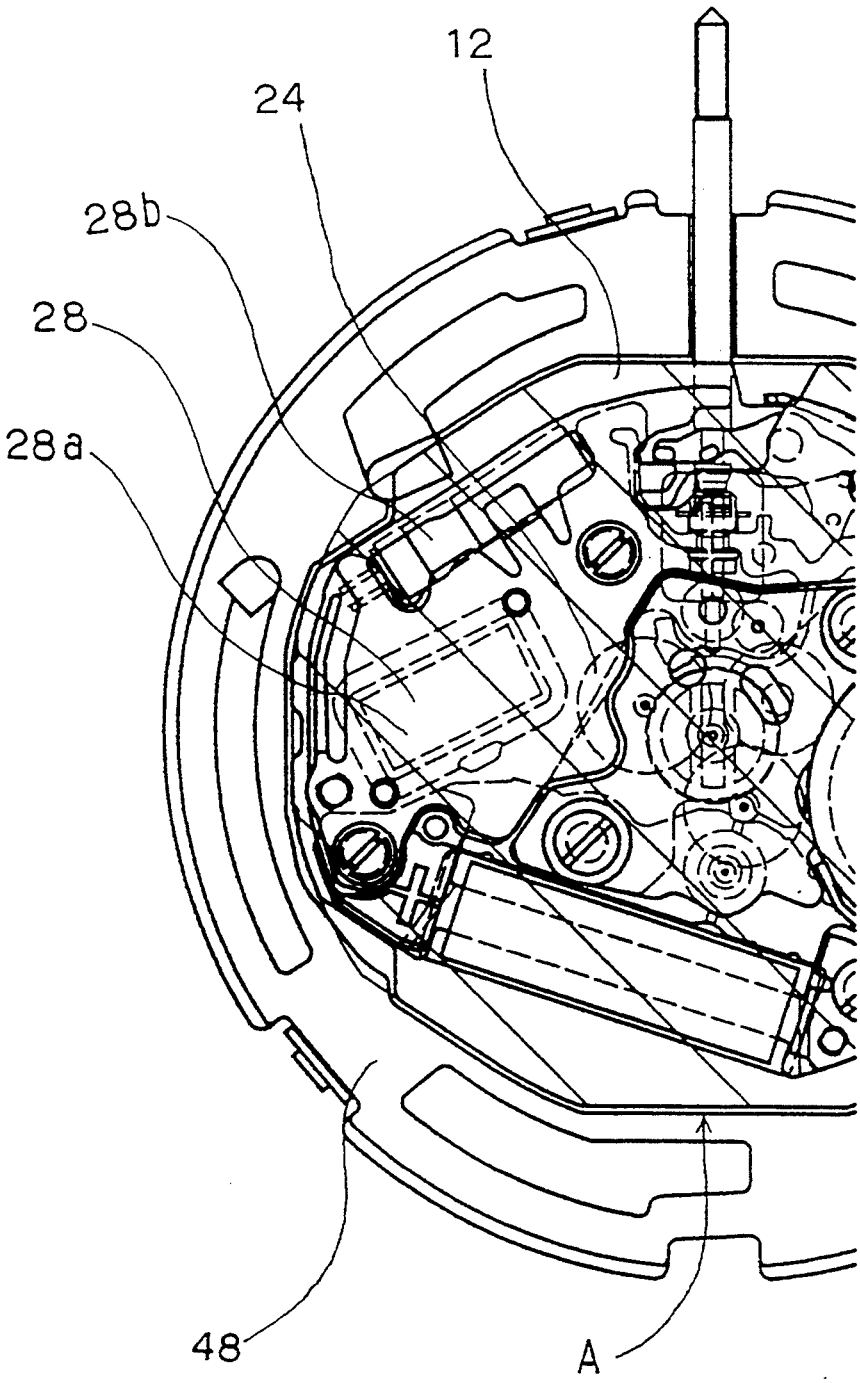
FIG. 2 is a plan view of the left half of a preferred watch movement according to the present invention, viewed from the bottom cover side.
Figure 3:
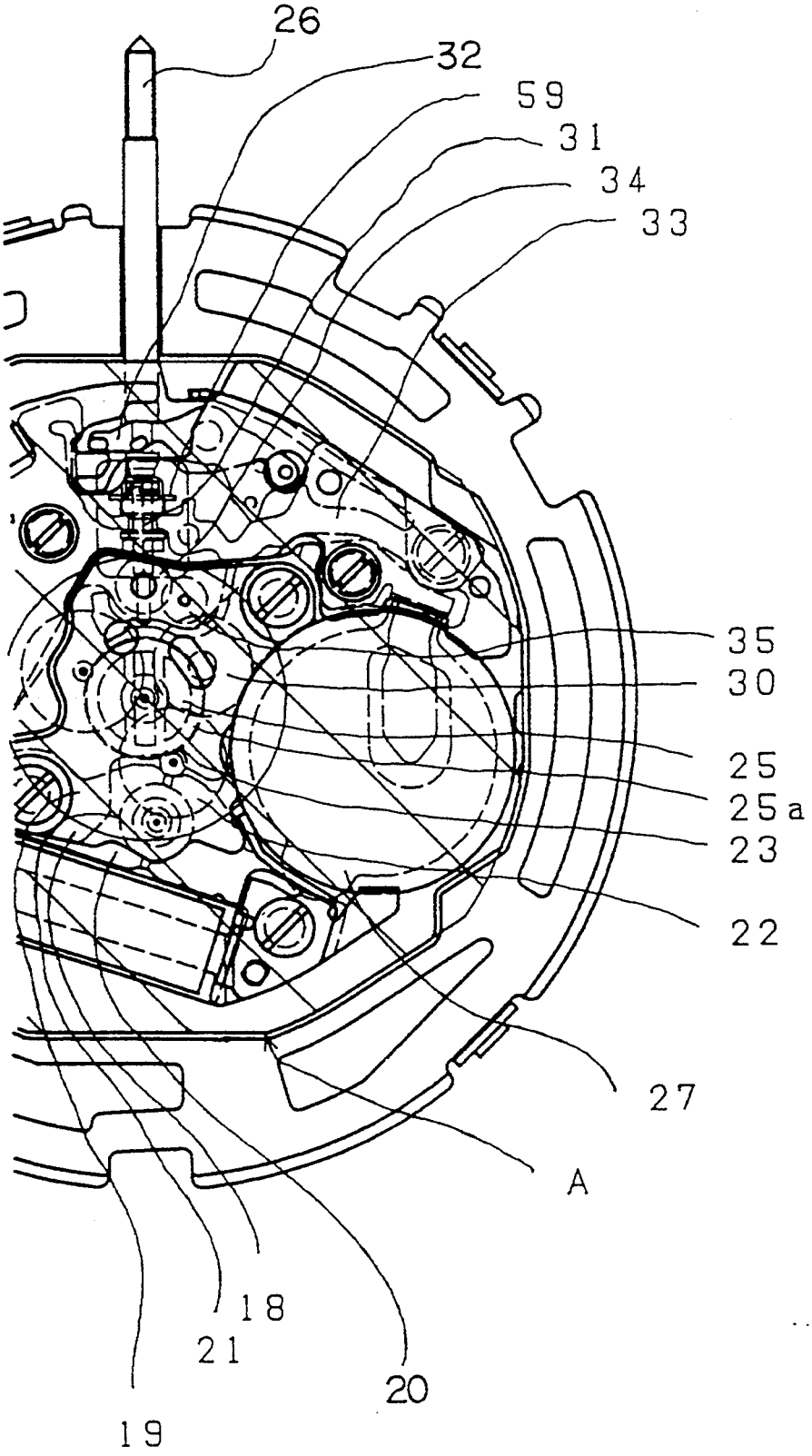
FIG. 3 is a plan view of the right half of a preferred watch movement according to the present invention, viewed from the bottom cover side.

As shown in FIG. 2 and FIG. 3, the base module A is supported by shafts of the foundation plate 12 together with a gear train bearing 18 and an intermediate bearing 19 and the like, and comprises a rotor 21 forming a step motor 20 as an electromechanical converter; a hands gear train mechanism made up of a fifth wheel 22, a fourth wheel 23, a third wheel 24 or a center wheel 25 and the like; an externally operated switching mechanism containing a winding stem 26 to which the crown 8 is attached, and, in addition, a battery 27 which is the power source for an electronic watch, as well as a circuit block 28 on which an IC chip 28*a* and a quartz oscillator 28*b*, and the like are mounted.

The fourth wheel 23, to which the second hand 3 is attached, is positioned at approximately the center of the base module A and is driven by the rotor 21 through the fifth wheel 22. The rotation of the fourth wheel 23 is transmitted further, through the third wheel 23, to the center wheel 25 to which the minute hand 2 is attached. As shown in FIG. 6, the center wheel 25 has a commonly known slip structure comprising a center gear 25*a* and a center wheel pinion 25*b*. A minute transmission wheel 29 for driving the later-explained gear train 15 for different-time display is engaged by the center wheel pinion 25*b*, and the minute transmission wheel 29 is driven at the same speed of rotation as the center wheel 25, making one revolution in 60 minutes.

Said center wheel 25 forms a gear train for hands and engages (see FIG. 3) a first minute wheel 30 which makes up a back gear train for adjustment of the hands for indicating current time. The first minute wheel 30 drives the center wheel 25 linked to the rotation of a sliding pinion 31 which rotatingly engages the winding stem 26. Specifically, when the crown 8 is in the two-stage pull state for setting the hands, the sliding pinion 31 linked to the winding stem 26 is shifted to a position for engaging a small steel wheel 34, and linked to the rotary operation of the crown 8, and the rotational force is transmitted along the route from the small steel wheel 34 to a back transmission wheel 35 to the first minute wheel 30.

Next, the different-time display gear train 15 and the calendar display gear train 16 will be explained with reference to FIG. 4 to FIG. 8.

Now referring to FIG. 6, the center hole of the minute transmission wheel 29 which engages the center wheel 25 arranged in the base module A engages the outer diameter of the intermediate hub section 25*c* of the center wheel pinion 25*b*, and a projection 29*a* provided on the minute transmission wheel 29 is formed to engage one section of a tooth profile 25*d* of the intermediate hub section 25*c* in a flat plane. In this manner, the projection 29*a* engages the tooth profile 25*d* and reliably transmits the rotational force from the center wheel 25 to the subsequent wheel. Accordingly, in comparison with a solid structure in which a minute transmission wheel made of synthetic resin is fixed by pressure to the hub section of the center wheel, as seen on some watches, when the minute transmission wheel 29 is mounted on or dismounted from the center wheel 25 in a watch of this configuration, there is but little occurrence of an excess load on the other parts, therefore the parts can be assembled in a stable manner, with no damage occurring.

Figure 4:
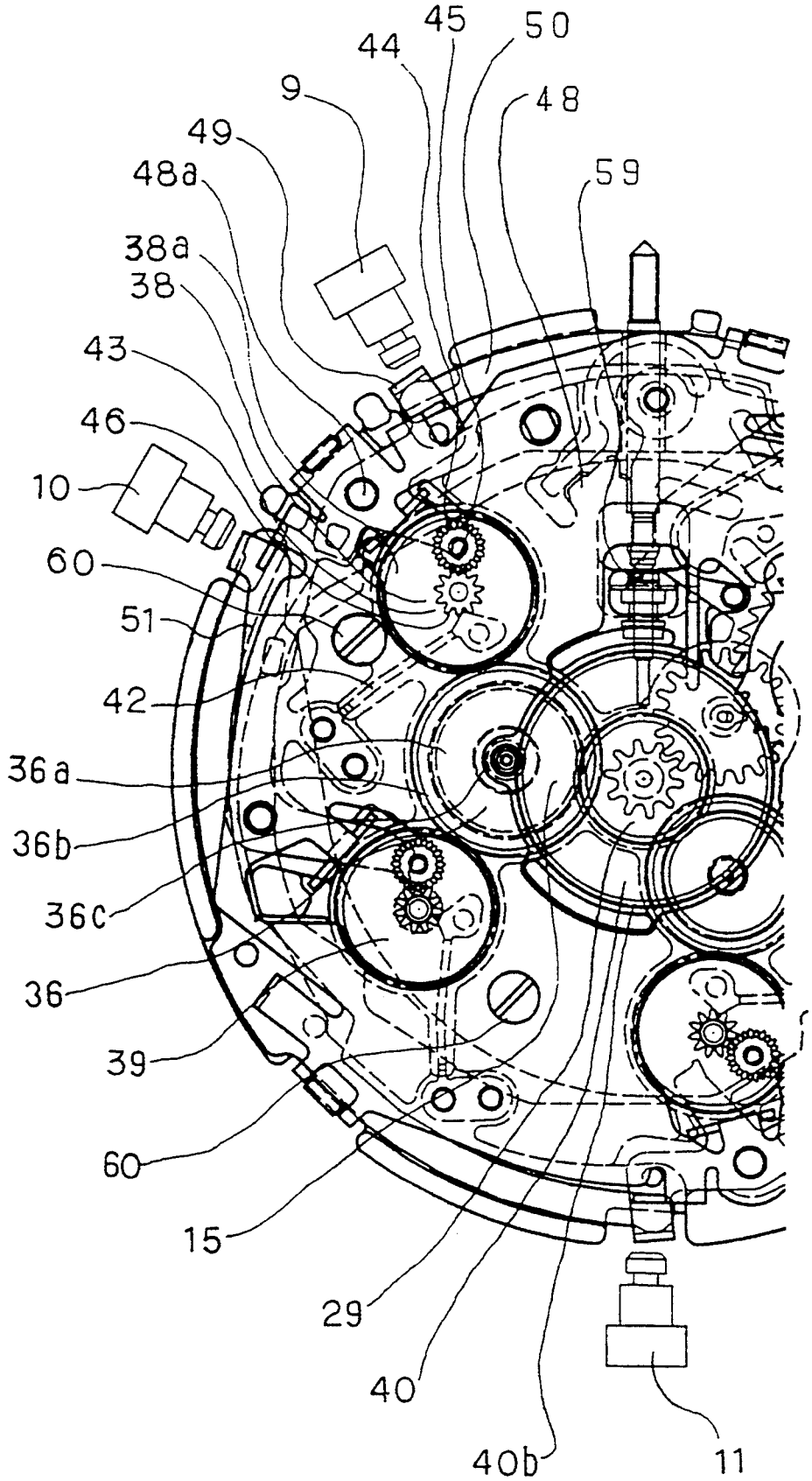
FIG. 4 is a plan view of the left half of a preferred watch movement according to the present invention, viewed from the hands side.
Figure 5:
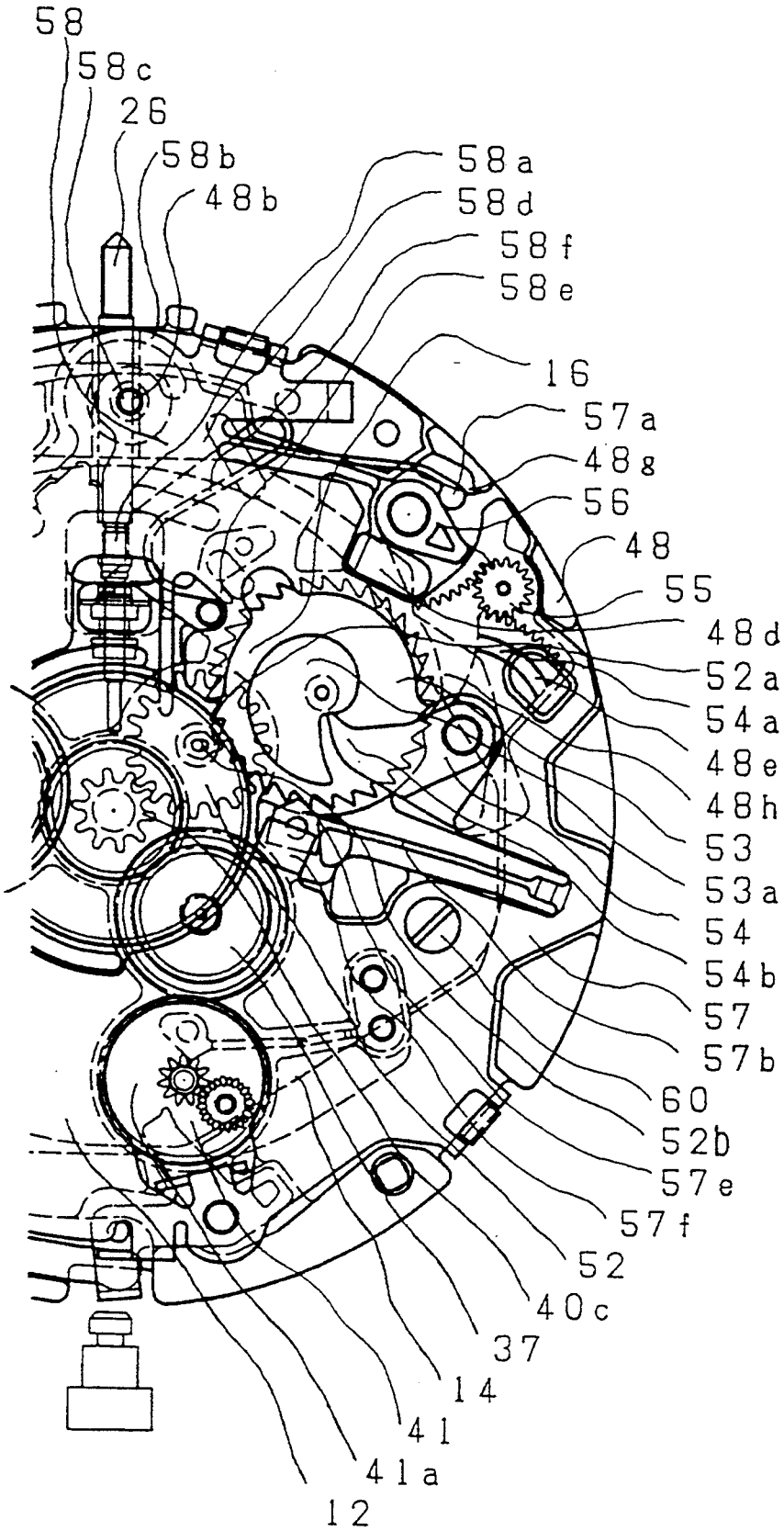
FIG. 5 is a plan view of the right half of a preferred watch movement according to the present invention, viewed from the hands side.

Now referring to FIG. 4 and FIG. 5, the rotational force of the minute transmission wheel 29 is transmitted to both a second minute wheel 36 and a third minute wheel 37 which are arranged not being overlapped in a flat plane. Said second minute wheel 36 is composed of a gear section 36*a*, a gear section 36*b*, and a dog section 36*c* arranged at approximately the center of a flat space with an almost delta pattern which are formed by a dual center wheel 38 of the first different-time display section 4 and a dual center wheel 39 of the second different-time display section 5. Then, the gear section 36*a* engages the minute transmission wheel 29; the gear section 36*b* engages a dual center gear 38*a* forming the dual center wheel 38 and a dual center gear 39*a* forming the dual center wheel 39; the dog section 36*c* engages an hour wheel 40 which is attached to the hour hand 1 for displaying the current time; and at the same time, the various engaging sections are arranged so that they do not overlap each other in a flat plane.

Said gear section 36*a* and tile gear section 36*b* are idling wheels for transmitting the rotation of the minute transmission wheel 29 and the rotation of the dual center gears 38*a*, 39*a* so that they simply rotate at the same speed. As illustrated in FIG. 6, because the engaging cross-section arrangement is double-layered and the pairs of the gear section 36*a* and the gear section 36*b* are engaged, the wheel ratio of the tooth profile can be selected comparatively free in a gear train as compared to a conventional idler wheel.

For this reason, the number of teeth in the minute transmission wheel 29, the dual center gear 38*a*, and the dual center wheel 39*a*, can be not necessarily the same. In addition, when considering the design characteristics of the watch, it is possible to place a suitable position for the engagement of the dual center wheel 38 and the dual center wheel 39 corresponding to a flat position the different-time display sections.

As illustrated in FIG. 5, the third minute wheel. 37 engages a dual center gear 41*a* of a dual center wheel 41 forming the third different-time display section 6, and transmits the rotation of the minute transmission wheel 29 at the same speed, in the same manner as the second minute wheel 36.

The different-time display gear train 15 which is attached to and rotates the LT hour hands 4*a*, 5*a*, 6*a* and the LT minute hands 4*b*, 5*b*, 6*b*, which are the structural elements of the different-time display sections 4, 5, 6, is driven by the following type of gear train structure.

Since the part of the gear train for the minute transmission wheel 29 to the second minute wheel 36 or the third minute wheel 37 section takes the same structure for the first different-time display section 4, the second different-time display section 5, and the third different-time display section 6, an explanation will therefore be given here only for the gear train structure of the middle section of the first different-time display section 4, with reference to FIG. 4 and FIG. 6.

The middle section of the gear train which makes up the first different-time display section 4 adopts the so-called planetary wheel system and has the following configuration. Specifically, a center shaft 14*a* is set into the lower bearing 14. The dual center wheel 38 and a dual wheel 43 engage the center shaft 14*a*, and a dual hour wheel 46 engages the dual center wheel 38. There are 11 teeth on the dual wheel 43. The rotation is regulated by a dual jumper spring 42. The dual center wheel 38 comprises the dual center gear 38*a* which engages the second minute wheel 36, and a pair of planetary wheels 44, 45 which are provided above and below the dual center gear 38*a*. The planetary wheel 45 is integrally formed with a projecting shaft 45*b* to which the planetary wheel 44 is concentrically attached through a rotational hole 38*b* provided in the dual center gear 38*a*.

In addition, the 12-tooth dual hour wheel 46, to which the LT hour hand 4*a* is attached, engages the planetary wheel 45, and is positioned concentrically with the dual wheel 43 and the dual center wheel 38. The dual hour wheel 46, the dual center wheel 38, and the dual wheel 43 are persistently pressed to the lower bearing side as a result of the spring reaction of a dual hand bearing 47 with spring characteristics, positioned in a hollow cross-section between the dial 13 and the dual hour wheel 46.

The dual center wheel 38, which rotates at the same speed as the center wheel 25 via the second minute wheel 36, makes one rotation in 60 minutes in the clockwise direction. In line with the rotation of the dual center wheel 38, the planetary wheel 44, which engages the dual wheel 43, rotates to the right around the rotation hole 38*b* provided in the dual center gear 38*a* while sliding along the locus of the tooth profile 43*a* of the dual wheel 43 which is position-regulated.

The planetary wheel 45 is synchronized with the planetary wheel 44 and rotates in the same direction. In addition, the dual hour wheel 46 engages the planetary wheel 45 at a speed reduction of 1/12 with respect to the dual center wheel 38 and is rotated to the right in the same manner as the dual center wheel 38 as a result of the force of the pressure from the tooth profile of the planetary wheel 45 overcoming the frictional force between the dual hand bearing 47 and the dual hour wheel 46. The same rotary action is applied to drive the dual center wheel 38 and the dual hour wheel 46 for setting the hands as in the normal operation.

The time adjustment of the LT hour hands which indicate local times will now be explained with reference to FIG. 4 and FIG. 6.

A dual adjustment lever 49, which is rotatably operated to be centered around a boss 48*a* integrally formed with a calendar plate 48 made of synthetic resin, is positioned close to the dual wheel 43 and linked to the external operating member PB9. Each time the PB9 is depressed, the dual wheel 43 which engages the tooth profile 43*a* is rapidly advanced by one hour. When the PB9 is released, the dual adjustment lever 49 is halted in a specified normal position by a return spring 50 arranged on the outer periphery of the watch movement.

The foregoing description specifically applies to the hand setting and adjustment mechanism and the like for the first different-time display section 4. However, the other different-time display sections 5, 6 have basically the same mechanism. In particular, the operating direction for adjustment and the action of the return spring and the like of the second different-time display section 5 are the same, though the shape of a dual adjustment lever 51 differs from that of the dual adjustment lever 49 because the second different-time display section 5 is linked to the PB10 arranged in the 2 o'clock position to improve the operability when adjusting the time difference.

As outlined above, the current time display gear train and the different-time display gear trains are linked so that it is possible to adjust the hands for the different-time display sections simultaneously, simply by adjusting the hands for the current time. Further, the time adjustment can be set for the different time display sections by a one-touch operation of a push button as previously described. Conventional display setting errors are therefore eliminated because the method of operation is easily understood so that it is difficult for the wearer to make an error.

Next, a calendar mechanism by which the day hand 7*a* is driven to swing over a one-month period will be explained with reference to FIG. 5 and FIG. 7.

The hour wheel 40 is provided with a cylindrical section 40*a* to which is attached the hour hand 1 for indicating the current time, and is also provided with a day rotary transmission wheel 40*c* on the side surface an hour wheel 40*b* opposite the cylindrical section 40*a* for engaging the dog 36*c* of the second back wheel 36. The day rotation transmission gear 40*c* transmits rotational force to a day rotary wheel 52, which is the next stage wheel, making one rotation in 12 hours.

The day rotary wheel 52 makes one rotation in 24 hours, driven at a reduced speed of ½ that of the day rotation transmission gear 40*c*. In addition, a day rotary hook 52*a* on the day rotary wheel 52 is integrally formed for transmitting rotation to a day intermediate wheel 53 which comprises a cam device for swinging and setting the day hand 7*a* over a one-month period. The rotary hook 52*a* engages the day intermediate wheel 53 once in 24 hours, making the day intermediate wheel 53 to rotate by 1/31 of a turn, and at the same time, transmits rotational force to a day wheel 55 and a day return wheel 56 to which the day hand 7*a* is attached through a day intermediate wheel 54.

Also, the day rotary wheel 52 is rotated around a day rotary wheel shaft 14*b* set in the lower bearing 14. When the day rotary hook 52*a* interferes with the day intermediate wheel 53 during fast adjustment of the day hand 7*a* (later described), the rotary hole 52*b*, through which the rotary wheel shaft 14*b* is engaged, is elongated in order to avoid the breakage of parts. As a result, when, for example, an external force is applied to the day intermediate wheel 53 through an external operating member, the rotational force from the day intermediate wheel 53 is transmitted to the day rotary wheel 52 via the day rotary hook 52*a* through the elongated rotary hole 52*b*. The day rotary wheel 52 therefore moves away from the engaging position as a result of the rotational force of the day intermediate wheel 53, causing no interference.

The cam device for swinging the day hand 7*a* comprises a cam 53*a* integrally formed on the day intermediate wheel 53; a lever 54*b* provided on the opposite side of a tooth profile 54*a* which engages the day wheel 55 for rotating around the day intermediate wheel 54; the day return wheel 56 provided for reliably operating a lever section 54*b* along the locus of the cam 53*a* with the lever section 54*b* of the day intermediate wheel 54 normally pressed to the cam 53*a* side via the day wheel 55; and a day return spring 57*a*. The cam 53*a* is contoured so that the day intermediate wheel 54 is driven at a uniform speed with the result that the day hand 7*a* is moved in uniform intervals, rotating to the right. The day intermediate wheel 53 is positioned by a day jumper spring 57*b* integrally formed with a back plate 57, stabilizing the static position of the cam 53*a* and the lever 54*b*, and preventing the fluctuation of the day hand 7*a* in the plane direction, as well as stabilizing the engagement with the day rotary hook 52*a*. The day intermediate wheel 53 also reliably engages a fast adjustment lever 58 which forms a fast adjustment mechanism for the day hand 7*a*.

The mechanism for fast adjustment of the day hand 7*a* will now be explained with reference to FIG. 8.

The fast adjustment mechanism for the day hand 7*a* comprises a fast adjustment hook 59 mounted on the sliding pinion 31 which axially engages the winding stem 26 made up of an externally-operating switching mechanism loaded on the basic module A; and a fast adjustment lever 58 which operates by rotating around the boss 48*b* integrally formed on the calendar plate 48. When the crown 8 is rotatably operated in the one-stage pull state of the winding stem 26, the fast adjustment hook 59 rotates together with the sliding pinion 31 linked rotatably with the winding stem 26, and the fast adjustment lever 58 is rotated around the boss 48*b*, by engagement with a projection 58*a* provided on the fast adjustment lever 58.

The fast adjustment lever 58 is integrally formed with a return spring 58*b* so that the rotational force normally works to return the fast adjustment lever 58 to the rest position for the previous operation when the engagement between the fast adjustment hook 59 and the projection 58*a* is released. The return spring 58*b* is integrally formed with a fast adjustment lever body 58*d* which is shaped to almost enclose a rotatable center section 58*c* of the fast adjustment lever 58, and receives a return force, normally contacting a stopper wall 48*c* (see FIG. 4) arranged on the calendar plate 48. In addition, the fast adjustment lever 58 is integrally formed with the feed hook 58*e* for rotating the day intermediate wheel 53 at least 1/31 of a turn from the fast adjustment state; and the spring section 58*f* which imparts elastic force to the feed hook 58*e* so that the rotation of the day intermediate wheel 53 does not reverse when the feed hook 58*e* returns to the rest position for the previous operation on completion of the adjustment.

Figure 10:
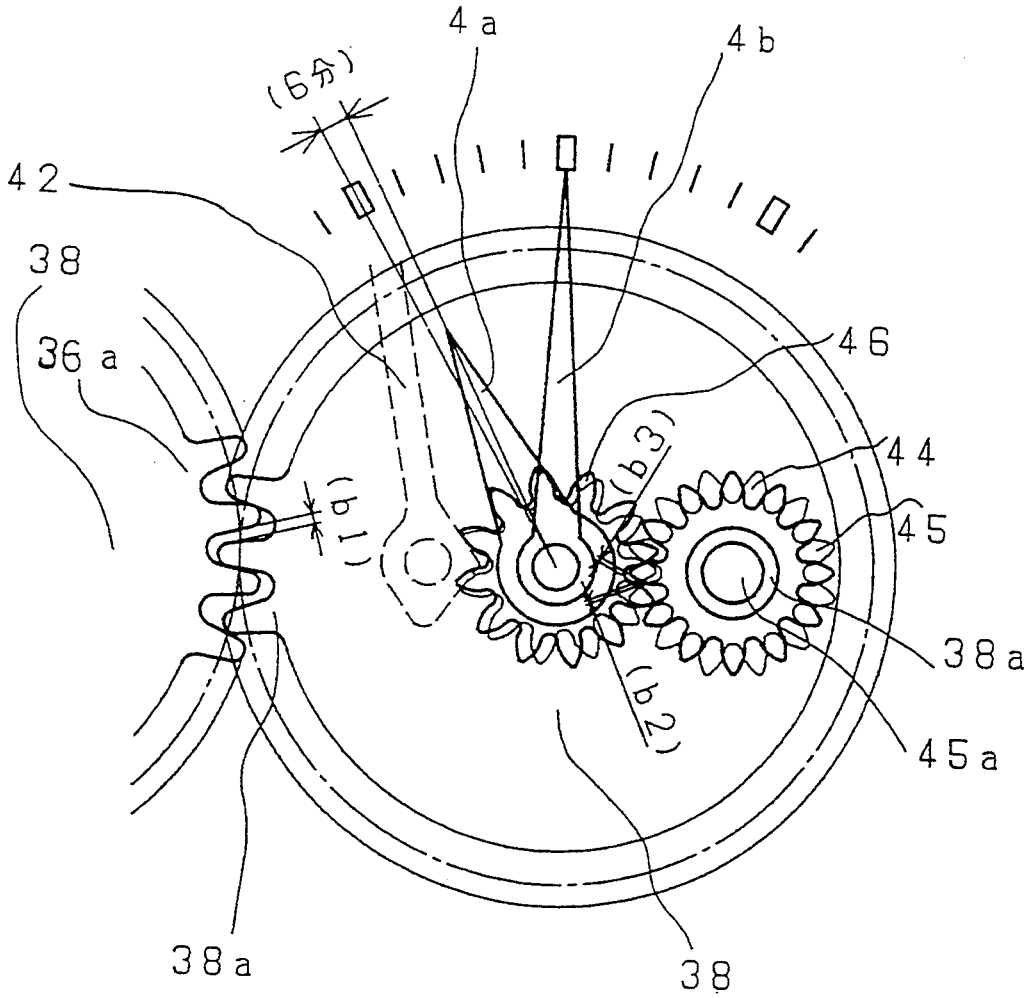
FIG. 10 is a plan view of a gear train section showing a one-hour delay state in the first different-time display section of the watch illustrated in FIG. 1, by operating an external operating member for a one-pitch rotation of a dual wheel in the counterclockwise direction.
Figure 11:
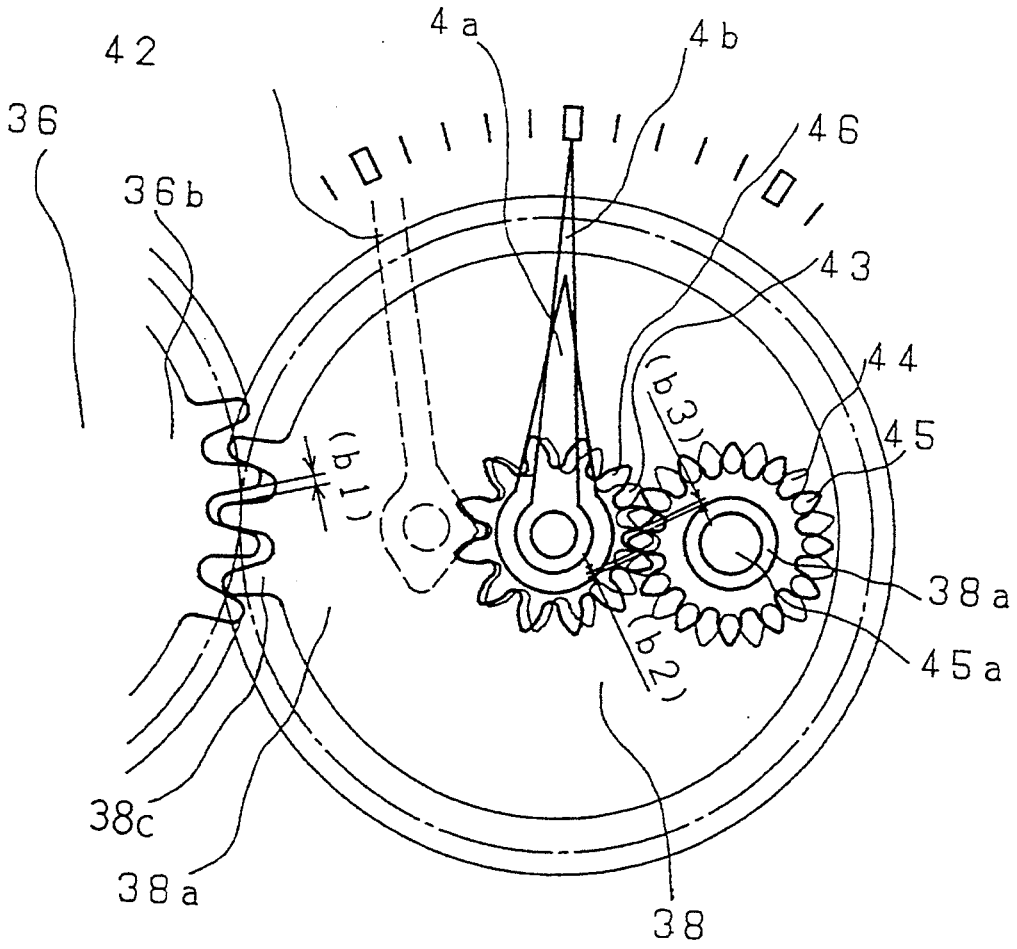
FIG. 11 is a plan view of a gear train section showing a one-hour advance state in the first different-time display section of the watch illustrated in FIG. 1, by operating an external operating member for a one-pitch rotation in the clockwise direction of a dual wheel.

The time adjustment operation for the LT hour hand and the LT minute hand will now be explained with reference to FIG. 9 to FIG. 11.

Figure 9:
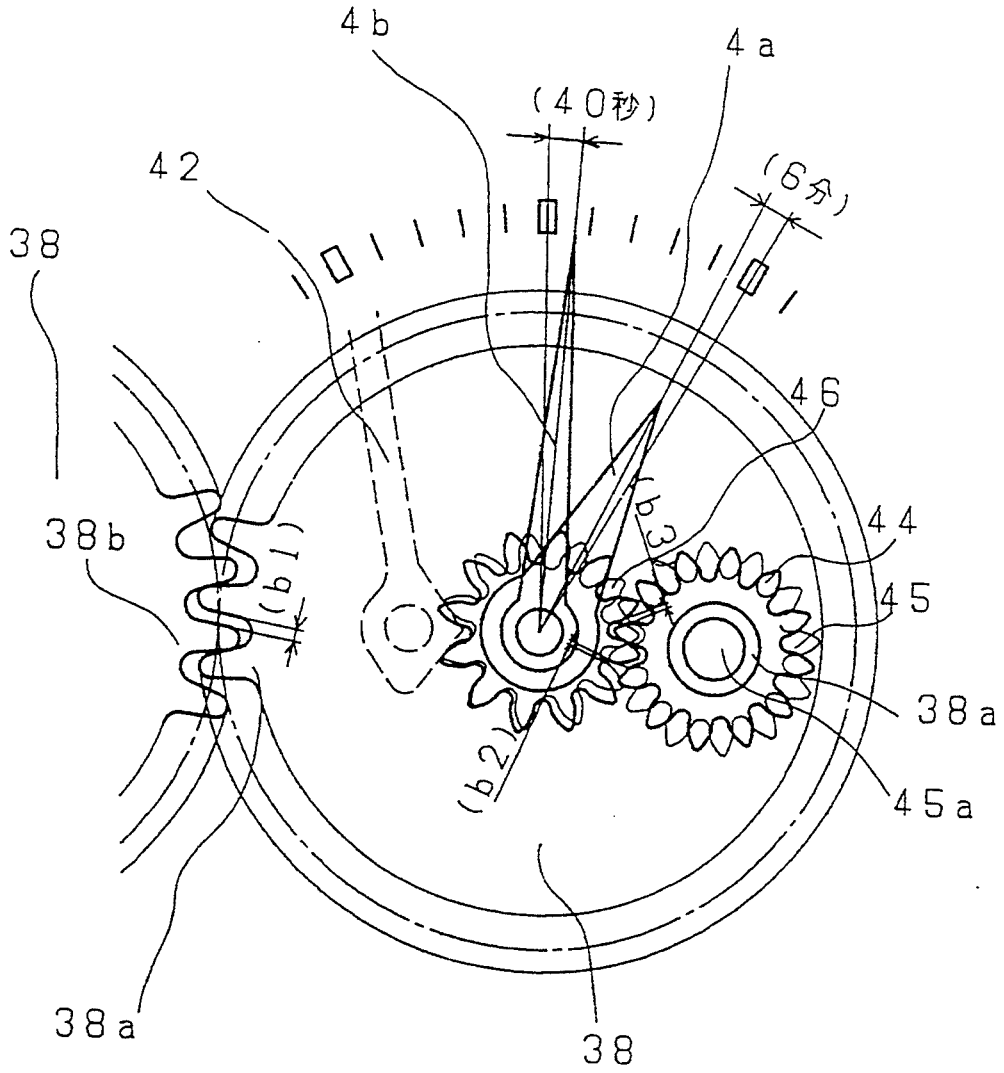
FIG. 9 is a plan view of a gear train section illustrating a state showing 12 o'clock position by normal hand movement of the first different-time display section of the watch illustrated in FIG. 1.

FIG. 9 is a plan view of a gear train section illustrating a state showing 12 o'clock position by normal hand movement of the first different-time display section 4. FIG. 10 is a plan view of a gear train section showing a one-hour delay for a one-pitch rotation of a dual wheel in the counterclockwise direction by the operation of an external operating member. FIG. 11 is a plan view of a gear train section showing a one-hour advance for a one-pitch rotation in the clockwise direction of a dual wheel by the operation of an external operating member.

When the hands are moved normally, the minute hang 2 of the basic module A is secured, and the LT minute hand 4*b* which engages the gear section 36*b* of the second minute gear 36 which rotates in the counterclockwise direction is secured.

An engaging backlash equal to b1 between the gear section 36*b* of the second minute gear 36 and a tooth section 38*c* of the dual center gear 38*a* of the dual center wheel 38, which rotates in the clockwise direction, is present in the forward, clockwise direction of the dual center gear 38*a* of the dual center wheel 38 which rotates forward. An engaging backlash equal to b2 between the 11-tooth dual wheel 43 regulated by the dual jumper spring 42 and the 12-tooth planetary wheel 44 which autorotates and revolves in the clockwise direction and is regulated by the dual center wheel 38 provided on the dual center wheel 38, is present in the clockwise direction of the planetary wheel 44 which rotates forward. An engaging backlash equal to b3 between the 12-tooth planetary wheel 45 provided on the dual center wheel 38 on the same shaft as the planetary wheel 44 and the 12-tooth dual hour wheel 46 is present in the clockwise direction of the dual hour wheel 46 which rotates forward.

Next, the PB9 of the external adjustment means is operated, ana when the dual wheel 43 is rotated one pitch (360/11) degrees in the counterclockwise direction by means of the dual adjustment lever 49, both the planetary wheels 44, 45 are rotated $(360/11)\times(11/12)$ degrees in the counterclockwise direction respectively, and the dual hour wheel 46 is rotated $(360/11)\times(11/12)\times(12/12)=30$ degrees in the clockwise direction so that the LT hour hand 4*a* only is set back one hour.

The above-mentioned backlashes will now be explained.

When the dual wheel 43 is rotated in the counterclockwise direction, the dual center gear 38*a* tends to rotate in the counterclockwise direction in the same manner as the dual wheel 43 by the pressure applied to the dual hand bearing 47. The direction of the engagement backlash equal to b1 between the gear section 36*b* of the second minute gear 36 and the tooth section 38*c* of the dual center wheel 38*a* is the same as during the normal hands movement., therefore the backlash equal to b1 has no effect on the LT minute hand 4*b* attached to the dual center wheel 38. Accordingly, no deviation is produced between the minute hand 2 displaying the current time and the LT minute hand 4*b* indicating the time for the different time zone.

In addition, in this state, the direction of the engagement backlash equal to b2 between the dual wheel 43 and the planetary wheel 44 is the same as during the normal hands movement, so that there is no effect from the backlash equal to b1.

The direction of the engagement backlash equal to b3 between the planetary wheel 45 and the dual hour wheel 46 is the reverse direction so that of the normal hands movement. The angle of rotation of the dual hour wheel 46 is therefore decreased by the backlash equal to b3, which is not exactly at 30 degrees as in the previous case, and the LT hour hand 4*a* advances to a little more than the 11 o'clock position. Normally, the backlash including the shaft clearance of the gear train for the size of a wrist watch is about 0.05 mm, and that of the 12-tooth dual hour wheel 46 becomes about three degrees, and accordingly the LT hour hand 4*a* advances and stops about six minutes ahead.

Next, if, for example, the dual wheel 4 3 is rotated in the clockwise direction by means of the PB or crown, the dual center gear 38*a* tends to rotate in the clockwise direction in the same manner as the dual wheel 43 by the pressure applied to the dual hand bearing 47. For this reason, the direction of the engagement backlash equal to b1 between the gear section 36*b* of the second minute wheel 36 and the wheel section 38*c* of the dual center gear 38*a* is in the direction opposite to that of the normal hands movement. The LT minute hand 4*b* attached to the dual center wheel 38 rotates in the clockwise direction in amounts equivalent to the backlash equal to b1, and the LT minute hand 4*b* indicating the time in another zone takes a position rather more advanced than the minute hand 2 which indicates the current time. The backlash equal to b1 is the backlash between the minute transmission wheel 29 and the gear section 36*a* of the second minute wheel 36, and tile angle of the dual center wheel 38 becomes about four degrees, when the shaft clearance of the second minute wheel 36 is taken into consideration. The LT minute hand 4*b* therefore stops at a position about 40 seconds advanced.

Further, in this condition the direction of the engagement backlash equal to b2 between the dual wheel 43 and the planetary wheel 44 is also the opposite direction to that of the normal hands movement, and the angle of rotation of the planetary wheel 44 and the planetary wheel 45 is decreased by the amount of the backlash equal to b2.

On the other hand, the direction of the engagement backlash equal to b3 between the planetary wheel 45 and the dual hour wheel 46 is the same direction as that of the normal hands movement. In this state, the dual hour wheel 46 is rotated and the angle of rotation is decreased by the amount of the backlash equal to b2, not exactly three degrees, and the LT hour hand 4*a* takes a position slightly behind the one o'clock. The backlash equal to b2 is equivalent to the previously-discussed backlash equal to b3, and that of the 12-tooth dual hour wheel 46 becomes about three degrees, and the LT hour hand 4a stops at a position about six minutes behind.

As described above, in the case where the time for the different time zone is adjusted in the direction in which the LT hour hand 4a is retarded at one hour intervals by rotating the dual wheel 43 counterclockwise, no deviation is produced between the LT minute hand 4b and the minute hand 2 which indicates the current time. The LT hour hand 4a only advances about six minutes and stops. However, in the case where the time for the different zone is adjusted in the direction in which the LT hour hand 4a is advanced at one hour intervals by rotating the dual wheel 43 clockwise, the LT minute hand 4b is stopped at a position about 40 seconds more advanced than the minute hand indicating the current time, while the LT hour hand 4a stops at a position about six minutes behind.

A calendar mechanism which drives the day hand 7a over a swing of one-month will now be explained with reference to FIG. 6 and FIG. 7.

The hour wheel 40 with the cylindrical section 40a to which the hour hand 1 for indicating current time is attached, engages the dog section 36c of the previously-described second minute wheel 36 and is provided with the day rotary transmission gear 40c on its upper section.

The day rotary transmission gear 40c, while making one rotation over 12 hours, transmits the rotational force to the day rotary wheel 52 which is the next stage wheel. The day rotary wheel 52 is also driven at a speed reduction ratio of ½ with respect to the day rotary transmission gear 40c and rotates once in 24 hours. Further, the day rotary wheel 52 is integrally formed with a hook 52a for day rotation which transmits the rotation to the day intermediate wheel 53, forming a cam mechanism which slides the day hand 7a over a one-month period. The hook 52a engages the day intermediate wheel 53 once in 24 hours, causing the day intermediate wheel to rotate 1/31 of a rotation, and transmitting rotational force to the day wheel 55, to which the day hand is attached, and to the day return wheel 56 via the day intermediate wheel 54.

The day rotary wheel 52 also rotates around the day rotary wheel shaft 14b set in the lower bearing 14. The rotary hole 52b engaged with the day rotary wheel shaft 14b is elongated in order to avoid the breakage of parts when, as is later described, the hook 52a for day rotation interferes the day intermediate wheel 53 during fast adjustment of the day hand 7a. By this elongated rotary hole 52b, no interference will occur when, for example, an external force is applied to the day intermediate wheel 53 through the external operating member. When the rotational force from the day intermediate wheel 53 is transmitted to the day rotary wheel 52 through the hook 52a via the rotary hole 52b, the day rotary wheel 52 then moves away from the engaging position as a result of the rotational force of the day intermediate wheel 53, so that there is no interference.

The cam device for swinging the day hand 7a comprises the cam 53a integrally formed on the day intermediate wheel 53; the lever 54b provided on the opposite side of the tooth profile 54a which engages the day wheel 55 for rotating around the day intermediate wheel 54; the day return wheel 56 provided for reliably operating the lever 54b along the locus of the cam 53a with the lever 54b of the day intermediate wheel 54 normally pressed to the cam 53a side via the day wheel 55; and the day return spring 57a (see FIG. 5). The cam 53a is contoured so that the day intermediate wheel 54 is driven at a uniform speed, and the day hand 7a is subsequently rotated to the right in uniform intervals.

As shown in FIG. 5, the day intermediate wheel 53 is positioned by the day jumper spring 57b integrally formed with the back plate 57, thus stabilizing the static position of the cam 53a and the lever 54b and preventing the day hand 7a from fluctuating in the plane direction, as well as stabilizing the engagement with the aforementioned day rotary hook 52a. The day intermediate wheel 53 engages reliably with the fast adjustment lever 58 to form a fast adjustment mechanism for the day hand 7a.

The mechanism for fast adjustment of the day hand 7a will now be explained with reference to FIG. 8 and FIG. 13.

The fast adjustment mechanism for the day hand 7a comprises the fast adjustment hook 59 mounted on the sliding pinion 31 which axially engages the winding stem 26 made up of the externally-operating switching mechanism loaded on the basic module A (see FIG. 3); and the fast adjustment lever 58 which rotates around the boss 48b integrally formed on the calendar plate 48. Then, when the crown 8 is rotatably operated in the one-stage pull state of the winding stem 26, the fast adjustment hook 59 rotates together with the sliding pinion 31 linked rotatably with the winding stem 26. The fast adjustment lever 58 is therefore rotated around the aforementioned boss 48a, engaged with a projection part 58a provided on the fast adjustment lever 58.

As shown in FIG. 5 and FIG. 8, the fast adjustment: lever 58 is integrally formed with a return spring 58b to ensure that the fast adjustment lever 58 will be returned to the rest position for the previous operation by rotational force when the engagement with the fast adjustment hook 59 and the projection part 58a is released. The return spring 58b is integrally formed of the fast adjustment lever body 58d so that the rotatable center section 58c of the fast adjustment lever 58 is almost enclosed and has a return force normally contacting the spring stopper wall 48c arranged on the calendar plate 48. Also, the feed hook 58e for rotating the day intermediate wheel 53 in the fast adjustment state at least 1/31 rotation, and the spring section 58f which imparts elastic force to the feed hook 58e are integrally formed on the fast adjustment lever 58. The day intermediate wheel 53, therefore, does not turn in reverse when the feed hook 58e returns to the rest position for the previous operation when the adjustment is completed.

The above-mentioned different-time display gear train 15 and the calendar mechanism, together with the lower bearing 14 and the calendar plate 48, are attached with screws to a screwed section 60 of the foundation plate 12 of the base module through the back plate 57 which has a shape almost the same as the profile of the watch movement As a result the cross-sectional position of the gear train 15 and the calendar mechanism are regulated.

Figure 12A:
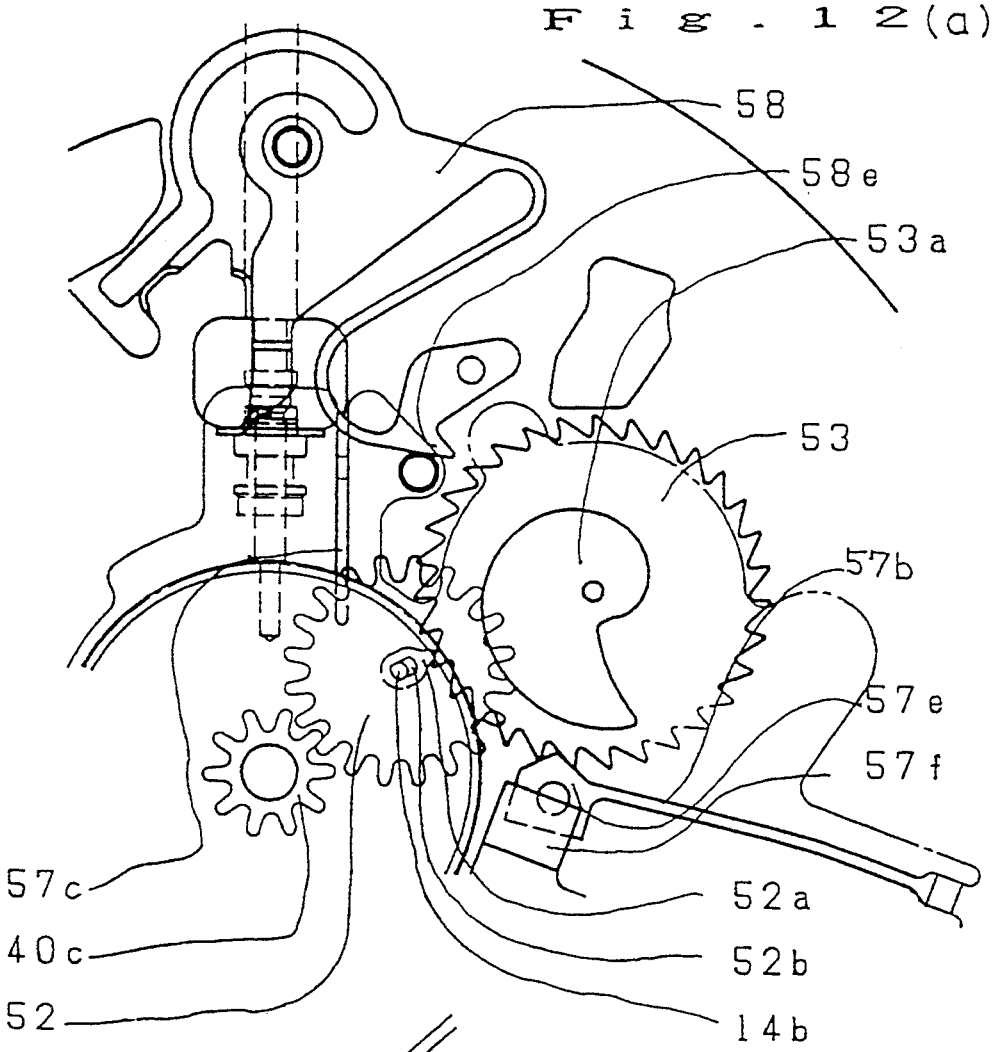
FIG. 12(*a*) and (*b*) are plan views of principal parts for explaining the action of a calendar gear train mechanism of the watch illustrated in FIG. 1.

FIG. 12 is a view taken from FIG. 7 to explain one part of the calendar gear train section in which a part of the back plate 57, other than the essential parts required for the explanation, is excluded. The function of the day rotary wheel 52 is explained with reference to FIG. 12.

Figure 12B:
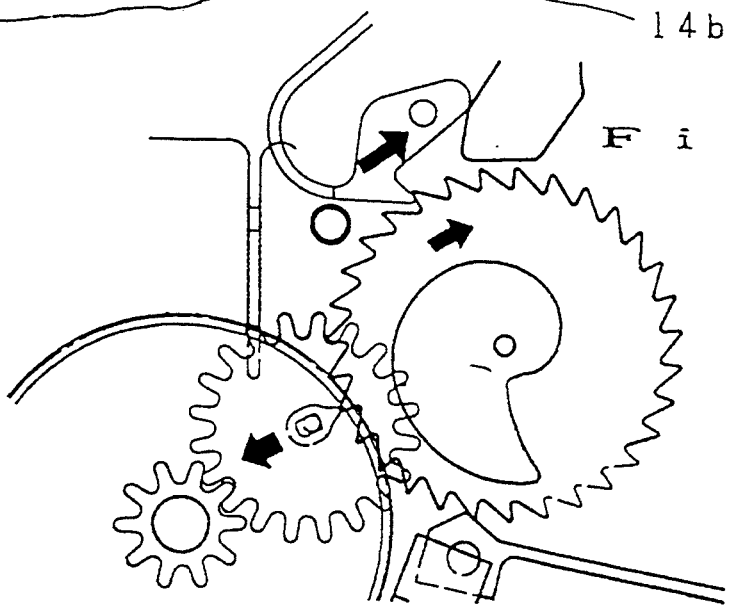

The day rotary wheel 52 rotates to the left around the day rotary wheel shaft 14b set in the lower bearing 14 as a result of the rotation of the day rotary transmission wheel 40c of the hour wheel 40 during normal hands movement. The case where the day rotary hook 52a.

interferes with the day intermediate wheel 53 during fast adjustment of the day hand *7a*, as later described, is that the day rotary hook 52*a* of the day rotary wheel 52 interferes with the wheel of the day intermediate wheel 53 immediately after the day rotary wheel 52 advances the calendar, as a result off the rotation of the day intermediate wheel 53. During this condition, in order: to adjust the calendar by rotating the crown 8, the rotary hole 52*b*, with which the rotary wheel shaft 14*b* is engaged, must be elongated so that no breakage of parts is produced, and a weak load is applied perpendicular to the gear surface of the day rotary wheel 52 by a day rotary pressure spring 57*d* integrally formed with the back plate 57. With this structure, the rotational force from the day intermediate wheel 53 is transmitted to the day rotary wheel 52 through the day rotary hook 52*a* when the day intermediate wheel 53 is rotated by means of the feed hook 58*e* of the fast adjustment lever 58. However, as illustrated in FIG. 12(b), the day rotary wheel 52 is rotated around the fulcrum where the load is applied and along the inside of the elongated rotary hole 52*b*, in the direction to move away from the engaging position by the rotational force of the day intermediate wheel 53. Thus, no interference is produced.

On the other hand, after the day rotary wheel 52 has been moved away from the day intermediate wheel 53, the rotation from the normal hands movement of the hour wheel 40 is transmitted to the day rotary wheel 52 which engages the day rotary transmission gear 40*c*. Then, the day rotary wheel 52 is rotated in the direction to approach the day intermediate wheel 53, around the fulcrum where the load by the pressure spring 57*b* is applied.

As shown in FIG. 5, the cam device which swings the day hand *7a* comprises the cam 53*a* which is integrally formed on the day intermediate wheel 53; the lever 54*b* provided on the opposite side of a tooth profile 54*a* of the day intermediate wheel 54 which engages the day wheel 55; the day return wheel 56; and the day return spring 57*a*. The day return wheel 56 normally presses the lever section 54*b* of the day intermediate wheel 54 against the side of the cam 53*a* via the day wheel 55, and acts such that the lever section 54*b* is reliably operated along the locus of tile cam 53*a*.

The cam 53*a* is contoured so that the day intermediate wheel 54 is driven at a uniform speed, and accordingly the day hand *7a* is moved in uniform intervals each day, rotating to the right.

Because the day intermediate wheel is positioned by the day jumper spring 57*b*, the day return wheel 56, to which the day return spring 57*a* is hooked, normally applies force in the direction to press the lever 54*b* of the day intermediate wheel 54 against the cam 53*a* via the engaging day wheel 55. As a result, the backlash between the gears in each of the day return wheel 56, the day wheel 55, and the day intermediate wheel 54 is converged in the previously stated direction, and it produces no deviation in the value of indication due to backlash. Therefore, no action is necessary to compensate for backlash, even in the case where the direction of movement of the day hand *7a* is changed as a result of the swinging action of the day wheel 55. In addition, the operability for the installation of the day hand *7a* is also improved because the position of the day wheel 55 is stabilized.

Furthermore, the static position of the cam 53*a* and the lever 54*b* is stabilized by the day return spring 57*a* and the jumper spring 57*b* on the calendar gear train, so that fluctuation of the day hand *7a* in the plane direction is prevented, and the engagement with the day rotation hook 52*a* is stabilized. This ensures engagement with the quick adjustment lever which forms the later-described fast adjustment mechanism of the day hand *7a*.

By hooking the jumper spring 57*b* on the day intermediate wheel 53, the jumper head section 57*e* of she jumper spring 57*b* is inserted under the jumper presser 57*f* of the back plate 57. This prevents release of the jumper spring 57*b* by external shock.

The day wheel 55 is positioned close to the periphery of the watch module because of a design limitation. For this reason, the day intermediate wheel 54 and the day return wheel 56 are formed with irregular shapes in order to avoid interference with the other parts, as shown in FIG. 5.

Therefore, functional problems such as misengagement between the day intermediate wheel 54 and the day return wheel 56 and the like may happen, if their relative position is not established when the module is to be assembled.

Accordingly, a pair of convex eaves 48*d*, 48*e* is provided on the above-mentioned two gear insertion sections on the calendar plate 48. The relative position between the day intermediate wheel 54 and the day return wheel 56 is fixed by insertion of the day wheel 55 after insertion of the day intermediate wheel 54 and the day return wheel 56 to fit the shape of a pair of guide sections 48*g*, 48*h* of the convex eaves 48*d*, 48*e* and the calendar plate 48. Of course, after insertion of the above-mentioned two gears, the wheel section is inserted below the convex eaves 48*d*, 48*e*.

Figure 13A:
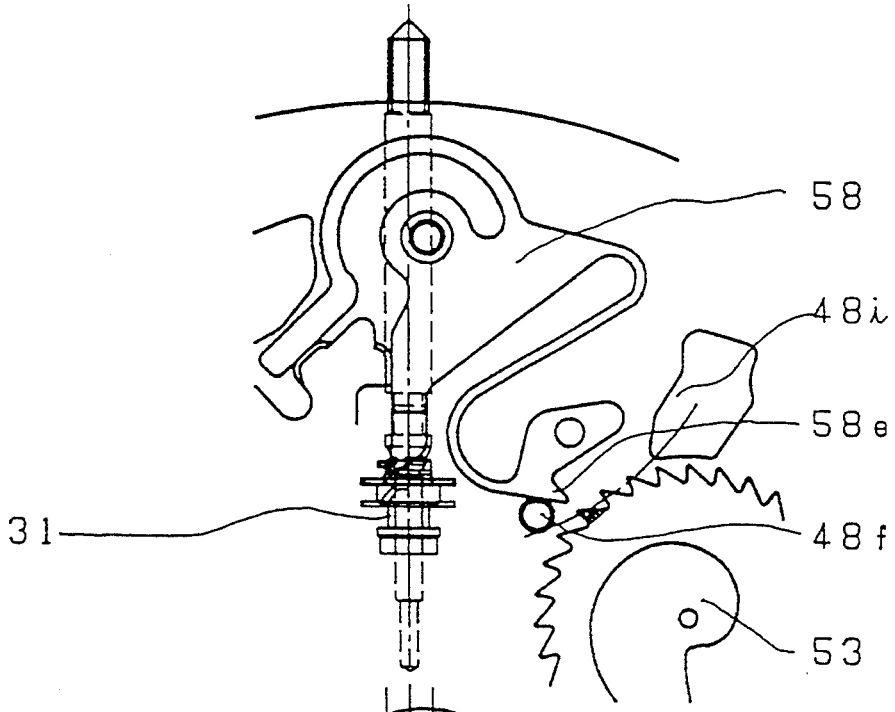
FIG. 13(*a*), (*b*), and (*c*) are plan views of principal parts for explaining the action of a calendar fast adjustment mechanism of the watch illustrated in FIG. 1.
Figure 13B:
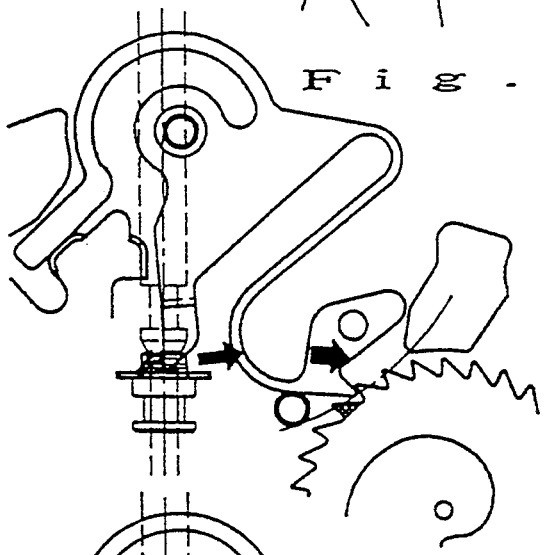
Figure 13C:
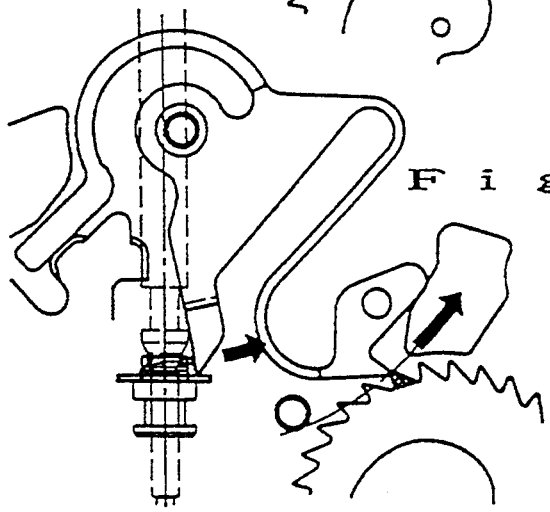

FIG. 13(*b*) and (*c*) are plan views showing the operating conditions of the fast adjustment mechanism. The feed hook 58*e* and a regulating boss 48*f* are provided to feed the day intermediate wheel 53 for one tooth at a time by the rotation of the fast adjustment lever 58 as a result of the rotation of the sliding pinion 31. An initial deflection is given to the spring section 58*f* of the fast adjustment lever 58 so that the feed hook 58*e* is hooked on the regulating boss 48*f* in the normal state. During fast adjustment, the feed hook 58*e* is inserted between the gears of the day intermediate wheel 53 (FIG. 10 (*b*) ) to slide on the side surface of the regulating boss 48*f* along with the rotation of the fast adjustment lever 58. Subsequently, the feed hook 58*e* is moved away from the regulating boss 48*f* and is rotated in an arc in the same manner as the fast adjustment lever 58, so that the operating locus of the day intermediate wheel 53 is regulated not to cause jump-up (FIG. 19 (*c*)).

In addition, in order to ensure that the feed hook 58*e* feeds no more than two teeth of the day intermediate wheel 53, a head section 58*c* of the fast adjustment lever 58 is activated along a guide wall 48*i* provided integrally on the calendar plate 48. The feed hook 58*e* therefore is disengaged from the day intermediate wheel 53 (FIG. 10(*c*)).

The cross-sectional position of the previously-explained different-time display gear train 15 and the calendar mechanism are regulated by setting them with the screwed section 60 on the foundation plate 12, together with the lower bearing 14 and the calendar plate 48, of the base module via the back plate 57, which is shaped almost the same as the profile of the movement.

What is claimed is:

1. A watch with hands for multiple time displays comprising:

a first hand display section positioned at approximately a center of a display section, a plurality of second hand display sections situated around the first hand display section and having dual center wheels (38, 39), a drive gear train for the first hand display section and including a second minute wheel (36) engaging simultaneously the dual center wheels (38, 39) of the plurality of the second hand display sections to move together, and an adjustment mechanism for the second hand display sections arranged independently from the drive gear train for the first hand display section, said adjustment mechanism including;

a dual wheel (43), the dual center wheel (38), planetary gears (44, 45) formed on the dual center wheel (38), an external adjustment member (9), and a dual adjustment member (49) rotationally driven by the external adjustment member (9), wherein said dual wheel (43) engages the planetary wheel (44) and is rotatably regulated by a jumper spring (42), said dual wheel (43) having a dual hour wheel (46) engaging the planetary wheel (45) and coaxially arranged therewith, said dual hour wheel (46) rotating by rotation of the dual center wheel (38) at a speed lower than that of the dual center wheel (38) and rotating at an integer fraction of one rotation relative to one pitch rotation of the dual wheel (43).

2. A watch with hands for multiple time displays as claimed in claim 1, wherein said dual hour wheel (46) rotates only one pitch in a counterclockwise direction by the dual adjustment member (9).

3. A watch with hands for multiple time displays comprising a first adjusting mechanism for a calendar display section, said first adjusting mechanism including:

a basic module A having a winding stem (26) operating as an externally-operating switching mechanism;

a sliding pinion (31) engaging the winding stem (26);

a fast adjustment hook (59) mounted on the sliding pinion (31);

a calender plate (48) having a boss (48*b*) integrally formed with the calender plate; and a fast adjustment lever (58) operated to rotate around the boss (48*b*) and having a feed hook (58*e*), wherein the fast adjustment hook (59) engages the fast adjustment lever (58); and an operating locus of the feed hook (58*e*) of the fast adjustment lever (58) is regulated by providing an initial deflection to said feed hook by a regulating boss 948*f*) so that the fast adjustment lever (58) is operated by rotation of a crown (8) of the winding stem (26).

4. A watch with hands for multiple time displays as claimed in claim 3, further comprising a cam device for swinging a day hand (*7a*) on the calender display section, said cam device including:

a cam (53*a*) integrally formed on an intermediate day wheel (53), a lever section (54*b*) provided on an intermediate day wheel (54), a day return wheel (56) provided for operating the lever section (54*b*) along a locus of the cam (53*a*) so that the lever section (54*b*) on the intermediate day wheel (54) is normally pressed to the cam (53*a*) side through a day wheel (55), and a day return spring (57*a*) for applying force in a direction for pressing the lever section against the cam.

5. A watch with hands for multiple time displays, comprising a cam device for swinging a day hand (*7a*) on a calender display section, said cam device including:

a cam (53*a*) integrally formed on an intermediate day wheel (53) with 31 teeth, a lever section (54*b*) provided on an intermediate day wheel (54), a day return wheel (56) provided for operating the lever section (54*b*) along a locus of the cam (53*a*) so that the lever section 954*b*) on the intermediate day wheel (54) is normally pressed to the cam (53*a*) side through a day wheel (55), and a day return spring (57*a*) for applying force in a direction for pressing the lever section against the dam;

said watch further including:

a day rotary wheel (52) having a rotary hole (52*b*) in an elongated shape;

a day rotation transmission gear (40*c*) for actuating an hour hand, and engaging the day rotary wheel (5) which in turn engages the intermediate day wheel (53); and a jumper spring (57*b*) for stabilizing a position of the intermediate day wheel (53).

* * * * *

UNITED STATES PATENT AND TRADEMARK OFFICE

CERTIFICATE OF CORRECTION

PATENT NO. : 5,339,293

DATED : August 16, 1994

INVENTOR(S) : Yasuo Kamiyama et al

It is certified that error appears in the above-identified patent and that said Letters Patent is hereby corrected as shown below:

Column 17, line 36 (claim 3, line 2), change "first" to --fast--; and line 37 (claim 3, line 3), change "first" to --fast--.

Signed and Sealed this

Twentieth Day of December, 1994

*Attest:*

Bruce Lehman

BRUCE LEHMAN

*Attesting Officer*

*Commissioner of Patents and Trademarks*